US010352554B2

(12) United States Patent
Tonomura et al.

(10) Patent No.: US 10,352,554 B2
(45) Date of Patent: Jul. 16, 2019

(54) SUPERHEATED STEAM GENERATOR

(71) Applicant: TOKUDEN CO., LTD., Kyoto-shi, Kyoto (JP)

(72) Inventors: Toru Tonomura, Otsu (JP); Yasuhiro Fujimoto, Kyoto (JP); Masayoshi Kimura, Otsu (JP)

(73) Assignee: TOKUDEN CO., LTD., Kyoto-shi, Kyoto (JP)

( * ) Notice: Subject to any disclaimer, the term of this patent is extended or adjusted under 35 U.S.C. 154(b) by 0 days.

(21) Appl. No.: 14/875,604

(22) Filed: Oct. 5, 2015

(65) Prior Publication Data

US 2016/0097529 A1 Apr. 7, 2016

(30) Foreign Application Priority Data

Oct. 6, 2014 (JP) ..... 2014-205942

(51) Int. Cl.
*F22G 3/00* (2006.01)
*F27D 7/02* (2006.01)
(Continued)

(52) U.S. Cl.
CPC ..... *F22G 3/00* (2013.01); *F22B 35/00* (2013.01); *F27D 7/02* (2013.01); *F27D 21/0014* (2013.01);
(Continued)

(58) Field of Classification Search
CPC ..... F22G 3/00; F27D 7/02; F27D 2017/006; F27D 21/0014; F27D 2019/0028; F22B 35/00
(Continued)

(56) References Cited

U.S. PATENT DOCUMENTS 3,814,901 A * 6/1974 Morhack ..... A47J 27/04 126/369
4,393,649 A 7/1983 Cheng
(Continued)

FOREIGN PATENT DOCUMENTS

CN 102628588 A 8/2012
CN 103459937 A 12/2013
(Continued)

OTHER PUBLICATIONS

European Patent Office, Extended European Search Report Issued in Patent Application No. 15188179.4, dated Feb. 5, 2016, Germany, 9 pages.
(Continued)

*Primary Examiner* — Steven B McAllister
*Assistant Examiner* — Benjamin W Johnson
(74) *Attorney, Agent, or Firm* — Alleman Hall Creasman & Tuttle LLP

(57) ABSTRACT

The present invention intends to suppress energy consumption while making it possible to generate superheated steam in a short period of time. Specifically, the present invention includes: a steam generating part that generates steam; a superheated steam generating part that generates superheated steam; an on/off valve that switches between supplying the steam to the superheated steam generating part or stopping the supply; and a control device that sends a control signal to the switching mechanism for switching between a waiting state in which the steam generating part generates the steam and the supply of the steam is stopped, and a supply state in which the steam is supplied to the superheated steam generating part. When switching from the waiting state to the supply state, the control device gradually increases an amount of the steam supplied to the superheated steam generating part.

4 Claims, 4 Drawing Sheets

(51) Int. Cl.

| | |
|---|---|
| ***F27D 21/00*** | (2006.01) |
| ***F22B 35/00*** | (2006.01) |
| *F27D 17/00* | (2006.01) |
| *F27D 19/00* | (2006.01) |

(52) U.S. Cl.
CPC ..... *F27D 2017/006* (2013.01); *F27D 2019/0028* (2013.01)

(58) Field of Classification Search
USPC ..... 122/451 R, 451.1, 451.2, 460, 466, 467, 122/483; 392/394, 399, 400, 405
See application file for complete search history.

(56) References Cited

U.S. PATENT DOCUMENTS

| | | | | |
|---|---|---|---|---|
| 4,823,767 | A * | 4/1989 | Wust | F22B 1/284 122/401 |
| 5,773,797 | A * | 6/1998 | Uemura | B24B 49/105 219/628 |
| 6,152,085 | A * | 11/2000 | Dethier | F22B 29/12 122/235.29 |
| 6,460,490 | B1 | 10/2002 | Knauss | |
| 2009/0159591 | A1 * | 6/2009 | Tomita | F22B 1/284 219/628 |
| 2014/0029924 | A1 | 1/2014 | Uchida | |

FOREIGN PATENT DOCUMENTS

| | | | | |
|---|---|---|---|---|
| CN | 203671584 | U | | 6/2014 |
| CN | 204962695 | U | | 1/2016 |
| EP | 2395284 | A1 | | 12/2011 |
| EP | 2562270 | A1 | | 2/2013 |
| JP | S46034141 | B | | 10/1971 |
| JP | 11108301 | A | | 4/1999 |
| JP | 11346645 | A | | 12/1999 |
| JP | 2003331878 | A | | 11/2003 |
| JP | 2004236991 | A | * | 8/2004 |
| JP | 2005144144 | A | | 6/2005 |
| JP | 2006226561 | A | | 8/2006 |
| JP | 2006226632 | A | | 8/2006 |
| JP | 2010249327 | A | | 11/2010 |
| JP | 2015135231 | A | | 7/2015 |
| KR | 20120016951 | A | | 2/2012 |

OTHER PUBLICATIONS

Japan Patent Office, Office Action Issued in Japanese Application No. 2014-205942, dated Nov. 28, 2017, 8 pages. (Submitted with English Translation of Office Action).
State Intellectual Property Office of the People's Republic of China, Office Action and Search Report Issued in Application No. 201510609217.7, dated Jul. 12, 2018, 14 pages.
State Intellectual Property Office of the People's Republic of China, Office Action and Search Report Issued in Application No. 201510609217.7, dated Nov. 23, 2018, 16 pages.

* cited by examiner

SUPERHEATED STEAM GENERATOR

TECHNICAL FIELD

The present invention relates to a superheated steam generator adapted to generate superheated steam.

BACKGROUND ART

This sort of superheated steam generator, for example as disclosed in Patent Literature 1, is one that includes a saturated steam generating part adapted to heat water to generate saturated steam and a superheated steam generating part adapted to heat the saturated steam to generate superheated steam.

The superheated steam generated by such a superheated steam generator is used for purposes such as to sterilize food before packing the food and to heat food in dining venues such as restaurants.

Meanwhile, a conventional superheated steam generator takes, for example, approximately 20 minutes to generate superheated steam of 700° C. from water at ordinary temperature even in the case of employing a relatively efficient induction heating method as heating means. In other words, the superheated steam cannot be generated until the above-described period has passed after attempting to dispense the superheated steam, and as a result, service providing time may be delayed, preventing customers from being satisfied in dining venues such as restaurants.

On the other hand, in the case of continuous operation of the generator to keep generating superheated steam, the above-described waiting time does not occur. However, in this case, even while superheated steam is not required, energy is continuously wastefully consumed, which is not preferable.

CITATION LIST

Patent Literature

Patent Literature 1: JP-A2006-226561

SUMMARY OF INVENTION

Technical Problem

Therefore, the present invention is made in order to solve the above-described problems, and a main object thereof is to suppress energy consumption despite generating superheated steam in a short period of time.

Solution to Problem

That is, a superheated steam generator according to the present invention includes: a steam generating part that generates steam, from water using an induction heating method or an electric heating method; a superheated steam generating part that is supplied with the steam generated by the steam generating part, and generates superheated steam from the steam using the induction heating method or the electric heating method; and a switching mechanism that is provided between the steam generating part and the superheated steam generating part, and switches supply of the steam to the superheated steam generating part or stops the supply, wherein the switching mechanism switches the supply of the steam or stops the supply, and thereby switching is performed between a waiting state that is a state where the steam generating part generates the steam and the supply of the steam is stopped, and a supply state where the steam is supplied to the superheated steam generating part.

In such a superheated steam generator, since the steam generating part preliminarily generates the steam in the waiting state before switching to the supply state, the time to generate the steam from the water within the time to generate the superheated steam can be reduced, and therefore the superheated steam can be generated in a shorter period of time than in conventional generators.

More specifically, for example, the case of generating superheated steam of 700° C. is described. In this case, the amount of heat necessary to generate saturated steam of 130° C. from water of ordinary temperature accounts for ⅔ of the total amount of heat necessary to generate the superheated steam of 700° C. Accordingly, the above-described superheated steam generator can make the steam generating part generate the saturated steam of 130° C. in the waiting state, and by switching from the waiting state to the supply state, can generate the superheated steam of 700° C. in approximately several seconds to several minutes.

Also, since the supply of the steam is stopped in the waiting state, the steam generating part is not required to keep generating the steam, and therefore by suppressing the energy consumed in the waiting state, energy can be saved.

In addition, energy consumed in the waiting state after energy has been saved includes energy such as the amount of heat corresponding to the amount of dissipated heat, which is applied to the steam generating part and the superheated steam generating part in order to compensate for the heat dissipated by the steam generating part and the superheated steam generating part.

When a large amount of the steam generated by the steam generating part suddenly flows into the superheated steam generating part that is waiting in a high temperature state, the superheated steam generating part is heat-shocked, and consequently may be damaged or reduced in life.

Therefore, it is preferable that the switching mechanism is an on/off valve, the superheated steam generator further includes a valve control part adapted to control the on/off valve, the valve control part starts to gradually open the on/off valve from a closed state to a predetermined valve opening degree, and thereby the switching is performed from the waiting state to the supply state.

This makes it possible to reduce the heat shock due to the sudden inflow of a large amount of the steam into the superheated steam generating part as described above because the steam is gradually supplied to the superheated steam generating part from a point in time when the waiting state is switched to the supply state.

It is preferable that the switching mechanism is a pressure regulating valve provided between the steam generating part and the superheated steam generating part, the superheated steam generator further includes a valve control part adapted to control the pressure regulating valve, and the valve control part controls the pressure regulating valve to switch from the waiting state to the supply state and regulate the pressure of the steam to be supplied to the superheated steam generating part.

In such a configuration, when the pressure of the steam to be supplied to the superheated steam generating part is regulated to zero, the superheated steam generator is brought into the waiting state, and by gradually increasing the pressure from the waiting state, the waiting state is switched to the supply state. According to this configuration, the pressure regulating valve can regulate the pressure of the steam while fulfilling a function as the above-described on/off valve, and therefore the one valve can be made to have both on/off and pressure regulating functions.

It is preferable that the superheated steam generator further includes a temperature control part that controls the heating temperature of the superheated steam generating part and the heating temperature of the steam generating part, and the temperature control part controls the heating temperature of the superheated steam generating part to a temperature higher than the heating temperature of the steam generating part in the waiting state.

Note that the term "heating temperature" here refers to a temperature such as the setting temperature of the heating means adapted to inductively heat or electrically heat a heating conductive tube through which fluid flows, or the temperature of the heating conductive tube itself.

In doing so, the steam generated by the steam generating part is heated immediately after having been supplied to the superheated steam generating part, and therefore the superheated steam can be generated in a shorter period of time.

It is preferable that the temperature control part controls the heating temperature of the superheated steam generating part on the basis of the temperature of the superheated steam generating part in the waiting state, and in the supply state, controls the heating temperature of the superheated steam generating part on the basis of the temperature of the superheated steam.

In doing so, even in the waiting state where no steam is present in the superheated steam generating part, the temperature of the superheated steam generating part can be kept at a desired temperature. In addition, in the supply state, the heating temperature of the superheated steam generating part is controlled on the basis of the temperature of the superheated steam, and therefore the superheated steam of a desired temperature can be surely generated.

It is preferable that the temperature control part switches a temperature used for the control of the heating temperature of the superheated steam generating part from the temperature of the superheated steam generating part to the temperature of the superheated steam after a predetermined time has passed since a point in time when the switching was performed from the waiting state to the supply state.

In doing so, in synchronization with the timing when the generation of the superheated steam is started in the supply state, the temperature used for the control of the heating temperature of the superheated steam generating part can be switched from the temperature of the superheated steam generating part to the temperature of the superheated steam.

Note that the superheated steam generating part in the supply state is supplied with a large amount of electric power and thereby kept at high temperature in order to control the superheated steam to the desired temperature. As a result, when switching from the supply state to the waiting state with the superheated steam generating part kept in the high temperature state, the superheated steam generating part reaches a higher temperature than the setting temperature in the waiting state, and in the case of running the generator at around the specified maximum temperature in the supply state, the generator may be damaged.

Therefore, it is preferable that the superheated steam generator is configured to stop the supply of the steam to the superheated steam generating part after a predetermined time has passed since a point in time when an operation for switching from the supply state to the waiting state was performed.

In doing so, during the predetermined time after the operation for switching from the supply state to the waiting state has been performed, the steam having the lower temperature than the temperature of the superheated steam generating part can be supplied to the superheated steam generating part to cool the superheated steam generating part. As a result, the superheated steam generating part can be cooled down to the setting temperature in the waiting state to prevent damage to the generator, or the like.

Advantageous Effects of Invention

According to the present invention configured as described, in addition to being able to generate the superheated steam in a short period of time after the superheated steam was requested, energy consumption in the waiting state can be suppressed.

DESCRIPTION OF EMBODIMENTS

In the following, one embodiment of a superheated steam generator according to the present invention will be described with reference to drawings.

Figure 1:
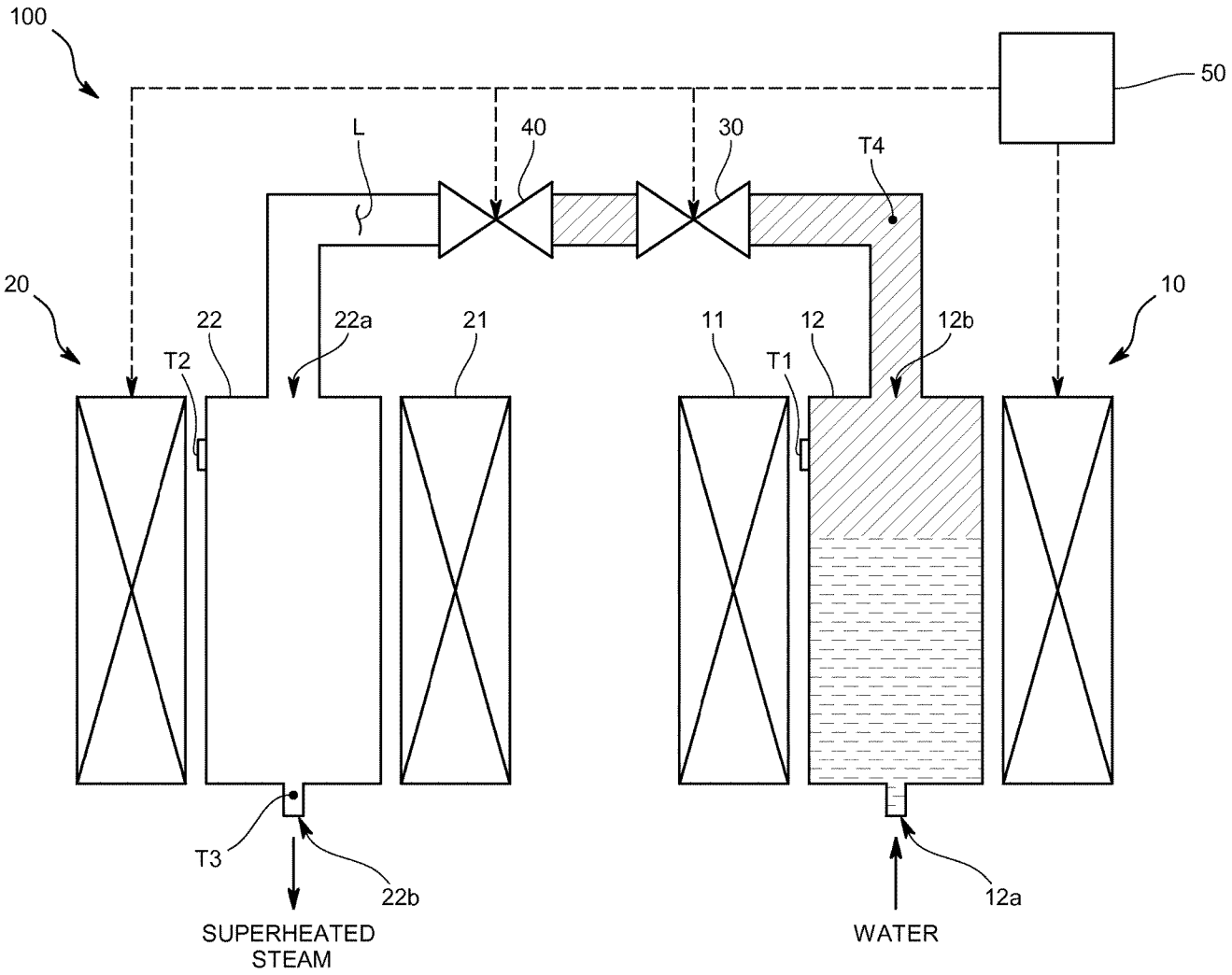
FIG. 1 is a diagram schematically illustrating a configuration of a superheated steam generator of the present embodiment.

A superheated steam generator 100 according to the present embodiment is an apparatus adapted to generate superheated steam by heating fluid, and as illustrated in FIG. 1, includes: a steam generating part 10 adapted to heat water to generate steam; a superheated steam generating part 20 adapted to heat the steam to generate superheated steam; and a supply flow path L adapted to connect the steam generating part 10 and the superheated steam generating part 20 to each other and supply the steam from the steam generating part 10 to the superheated steam generating part 20.

The steam generating part 10 is adapted to heat the water to generate the saturated steam of a predetermined temperature, and has first heating means 11 and a first heating element 12 heated by the first heating means 11. The first heating element 12 here is a heating conductive tube having a fluid introduction port 12*a* and a fluid lead-out port 12*b*. In addition, the water is introduced from the fluid introduction port 12*a*, and the saturated steam is led out from the fluid lead-out port 12*b*.

The superheated steam generating part 20 is adapted to heat the saturated steam to generate the superheated steam of a predetermined temperature, and has second heating means 21 and a second heating element 22 heated by the second heating means 21. The second heating element 22 here is a heating conductive tube similar to the first heating element 12, and has a fluid introduction port 22*a* and fluid lead-out port 22*b*. In addition, the saturated steam generated by the steam generating part 10 is introduced from the fluid introduction port 22*a*, and the superheated steam is led out from the fluid lead-out port 22*b*.

The first and second heating means 11 and 21 are adapted to heat the heating elements 12 and 22 by an induction heating method, and include induction coils provided around the heating elements 12 and 22 and power supplies for applying AC voltages to the induction coils, respectively. Here, magnetic path cores are provided in the centers of the induction coils, and by utilizing the magnetic path cores to efficiently circulate magnetic fluxes generated by the induction coils, the magnetic fluxes can be efficiently introduced into the heating elements 12 and 22, respectively. More specifically, a common core serving as a common path for the magnetic fluxes generated in the two magnetic path cores is provided. In addition, the top of the common core and those of the two magnetic path cores are mutually connected by a yoke core, and the bottom of the common core and those of the two magnetic path cores are mutually connected by another yoke core. This configuration makes it possible to reduce the total size of the cores, and thus downsize the generator overall.

The supply flow path L is connected to the fluid lead-out port 12*b* of the first heating element 12 at one end thereof, and connected to the fluid introduction port 22*a* of the second heating element 22 at the other end thereof. Also, the supply flow path L is adapted to supply the saturated steam generated by the steam generating part 10 to the superheated steam generating part 20. In the present embodiment, the supply flow path L is provided with a pressure regulating valve 30 such as a pressure reducing valve, and configured to be able to supply the saturated steam to the superheated steam generating part 20 with the saturated steam kept at a predetermined temperature or a predetermined pressure.

In addition, the superheated steam generator 100 of the present embodiment further includes a switching mechanism that is provided between the steam generating part 10 and the superheated steam generating part 20 to switch the supply of the saturated steam to the superheated steam generating part 20 or to stop the supply.

The switching mechanism here is provided in the above-described supply flow path L, and flows the saturated steam to the superheated steam generating part 20 through the supply flow path L or stops the flow, and specifically may be an on/off valve 40 such as a solenoid valve provided on the downstream side (on the superheated steam generating part 20 side) of the pressure regulating valve 30.

The superheated steam generator 100 of the present embodiment is configured to switch the on/off valve 40 between a closed state and an open state, and thereby switch between a waiting state that is a state where the steam generating part 10 generates the saturated steam and the supply of the saturated steam is stopped, and a supply state where the saturated steam is supplied to the superheated steam generating part 20.

In addition, the superheated steam generator 100 further includes a control device 50 adapted to control the above-described respective heating means 11 and 21 and respective valves 30 and 40.

Figure 2:
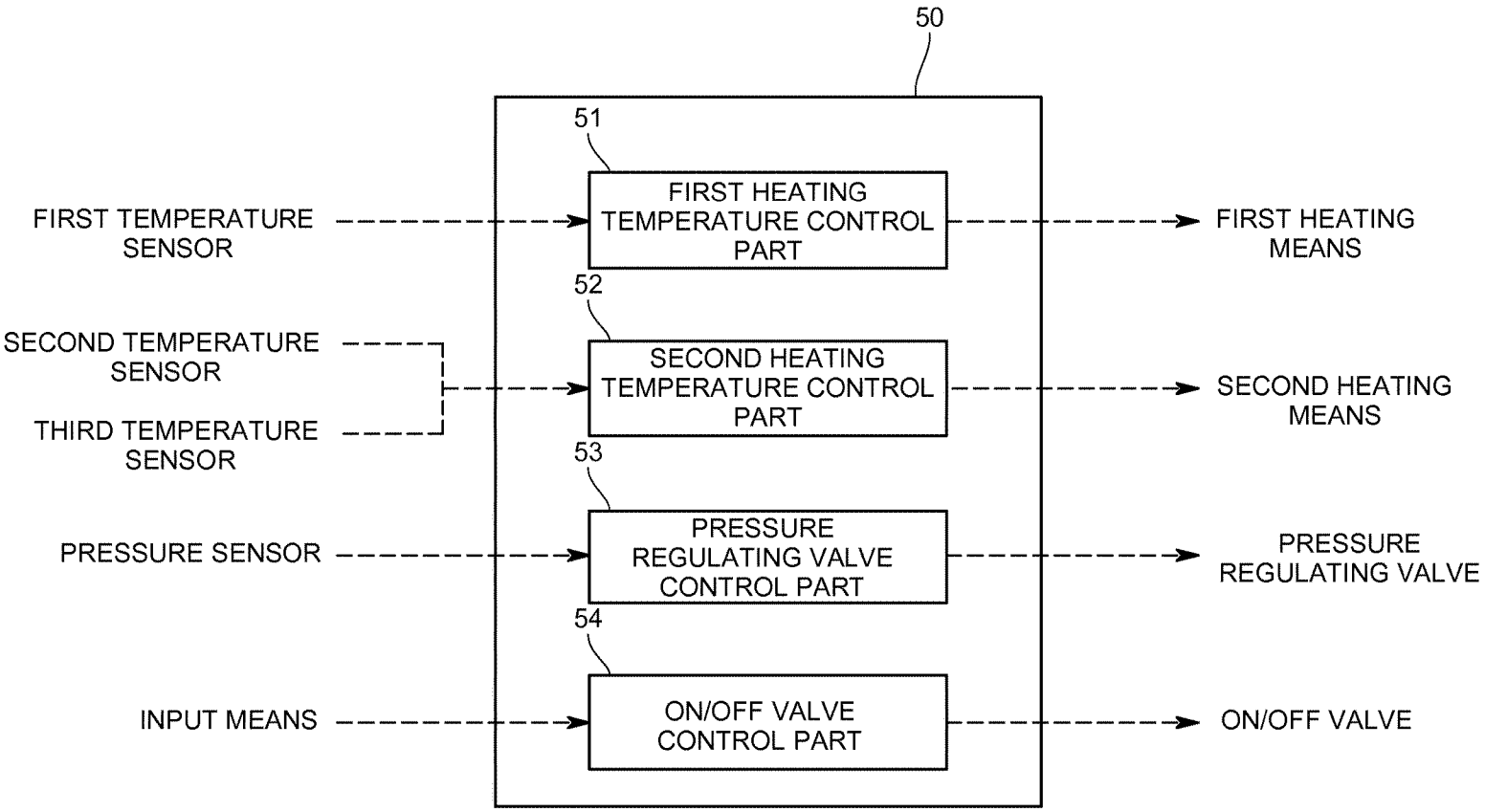
FIG. 2 is a block diagram functionally illustrating a control device in the same embodiment.

The control device 50 includes physically a CPU, a memory, an A/D converter, a D/A converter, and the like, and includes functionally, as illustrated in FIG. 2: a first heating temperature control part 51 adapted to control the heating temperature (hereinafter also referred to as the first heating temperature) of the steam generating part 10; a second heating temperature control part 52 adapted to control the heating temperature (hereinafter also referred to as the second heating temperature) of the superheated steam generating part 20; a pressure regulating valve control part 53 adapted to control the pressure regulating valve 30; and an on/off valve control part 54 adapted to control the on/off valve 40.

In the following, the action of the superheated steam generator 100 of the present invention will be described while describing the respective parts.

First, when a user activates the superheated steam generator 100, water in, for example, an unillustrated tank is supplied to the steam generating part 10.

In so doing, the first heating temperature control part 51 controls the first heating temperature so as to make the saturated steam generated in the steam generating part 10 reach a predetermined temperature, and in the present embodiment, the temperature of the first heating element 12 is defined as the first heating temperature.

Specifically, the first heating temperature control part 51 obtains a measured value from a first temperature sensor T1 provided on the first heating element 12 or a fourth temperature sensor T4 provided in the supply flow path L, and on the basis of the measured value, controls the amount of AC voltage applied to the induction coil of the first heating means 11 to control the first heating temperature to, for example, 100° C. to 140° C.

Note that the first temperature sensor T1 is preferably provided in the upper part or the fluid lead-out port 12*b* of the first heating element 12, or in the vicinity of the fluid lead-out port 12*b* in order to bring the measured value thereof closer to the temperature of the saturated steam.

Also, the pressure regulating valve control part 53 controls a valve opening degree of the pressure regulating valve 30 to a predetermined opening degree to make the saturated steam generated by the steam generating part 10 reach the predetermined temperature or a predetermined pressure. Here, the pressure regulating valve control part 53 is configured to obtain a measured value from an unillustrated pressure sensor provided in the supply flow path L, and on the basis of the measured value, control the valve opening degree of the pressure regulating valve 30 to the predetermined opening degree. In doing so, the saturated steam is kept at the constant pressure on the downstream side (on the superheated steam generating part 20 side) of the pressure regulating valve 30.

In addition, as described above, in the state where the steam generating part 10 generates the saturated steam, the on/off valve control part 54 controls the on/off valve 40 so as to bring a valve opening degree of the on/off valve 40 into a zero state, i.e., the closed state. In doing so, the superheated steam generator 100 comes into the waiting state that is the state where the steam generating part 10 generates the saturated steam and the state where the supply of the saturated steam is stopped.

In this waiting state, the second heating temperature control part 52 controls the second heating temperature to a temperature higher than the first heating temperature and, in the present embodiment, is configured to control the temperature of the second heating element 22 as the second heating temperature.

Specifically, in the waiting state, the second heating temperature control part 52 obtains a measured value from a second temperature sensor T2 provided on the second heating element 22, and on the basis of the measured value, controls the amount of AC voltage applied to the induction coil of the second heating means 21. By controlling the amount of the AC voltage, the second heating temperature is controlled to the setting temperature of the superheated steam generated in the superheated steam generating part 20 or a temperature around the setting temperature, and is controlled to, for example, 200 to 1200° C.

In the above-described waiting state, when the user externally inputs a switching signal using, for example, input means or the like, the on/off valve control part 54 obtains the switching signal to switch the on/off valve 40 from the closed state to the open state. In doing so, the superheated steam generator 100 is switched from the waiting state to the supply state, and the supply of the saturated steam to the superheated steam generating part 20 is started.

Figure 3:
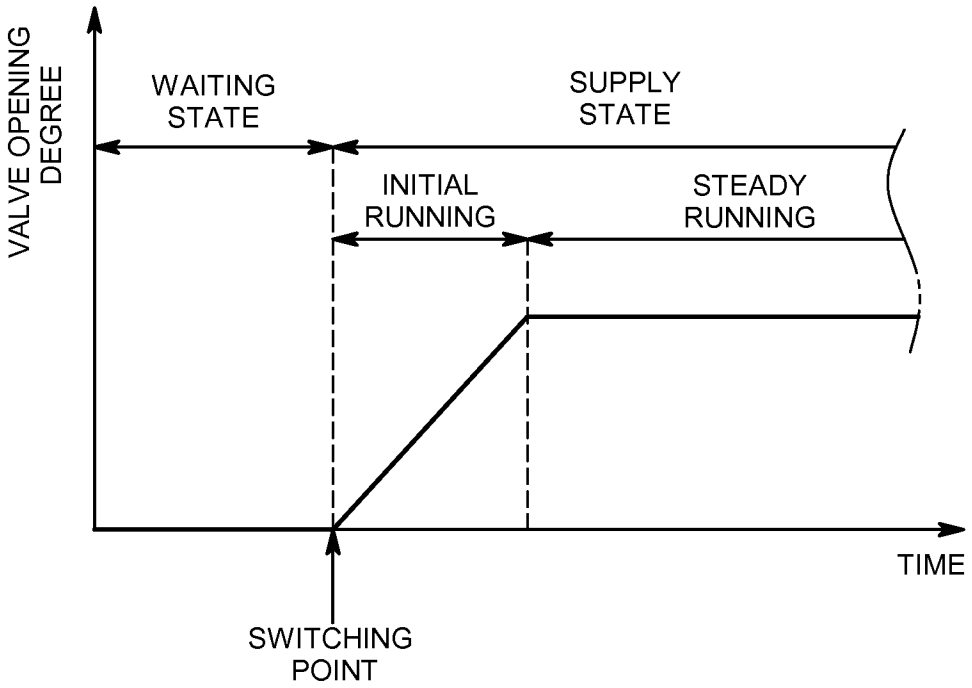
FIG. 3 is a graph illustrating the control of an on/off valve by an on/off valve control part in the same embodiment.

In so doing, the on/off valve control part 54 controls the on/off valve 40 so as to, as illustrated in FIG. 3, gradually open the on/off valve 40 to gradually increase the valve opening degree of the on/off valve 40 from zero to a predetermined opening degree. This leads to "initial running," where a supply amount of the saturated steam gradually increases from a switching point in time when the waiting state is switched to the supply state to a point in time when the valve opening degree of the on/off valve 40 reaches the predetermined opening degree, followed by "steady running," where the supply amount of the saturated steam is constant from the point in time when the valve opening degree reaches the predetermined opening degree.

Note that in the present embodiment, the second heating temperature control part 52 controls the second heating temperature on the basis of the measured value of the second temperature sensor T2 for a predetermined time after the switching point as described above. On the other hand, from a point in time when the predetermined time has passed, the second heating temperature control part 52 is configured to control the second heating temperature on the basis of the temperature of the superheated steam.

To describe a specific embodiment for such control, for example, in the fluid lead-out port 22*b* or in the vicinity of the fluid lead-out port 22*b*, a third temperature sensor T3 adapted to measure the temperature of the superheated steam led out of the fluid lead-out port 22*b* is provided. The second heating temperature control part 52 is configured to obtain a measured value of the third temperature sensor T3 from the point in time when the predetermined time has passed, and on the basis of the measured value, control the second heating temperature.

In addition, in the present embodiment, the predetermined time is set to a time from the switching point in time when the waiting state is switched to the supply state to a point in time when the lead-out of the superheated steam from the fluid lead-out port 22*b* of the second heating element 22 is started.

Next, an action to switch from the supply state to the waiting state will be described.

The superheated steam generator 100 of the present embodiment is configured to stop the supply of the saturated steam to the superheated steam generating part 20 after a predetermined time has passed since an operation for switching from the supply state to the waiting state was performed.

Note that the operation for switching from the supply state to the waiting state refers to an operation such as the external input of a switching signal by a user using input means or the like, or the output of a predetermined time passage signal by a timer or the like, indicating that the supply state has continued for the predetermined time.

More specifically, in the present embodiment, when the operation for switching from the supply state to the waiting state is performed, the above-described on/off valve control part 54 obtains a signal such as the switching signal or the predetermined time passage signal, and keeps the on/off valve 40 in the open state for a predetermined time after the obtainment. In doing so, the saturated steam is supplied from the steam generating part 10 to the superheated steam generating part 20 for the predetermined time.

Then, after the predetermined time has passed, the on/off valve control part 54 switches the on/off valve 40 from the open state to the closed state, and thereby the superheated steam generator 100 is switched from the supply state to the waiting state.

The superheated steam generator 100 according to the present embodiment configured as described can reduce the time to generate the steam from the water within the time to generate the superheated steam from the water because the steam generating part 10 preliminarily generates the steam in the waiting state. As a result, the superheated steam can be generated in a shorter period of time than before by switching from the waiting state to the supply state.

Also, since in the waiting state, the supply of the steam is stopped, the steam generating part 10 is not required to keep generating the steam, and therefore the energy consumed in the waiting state can be suppressed.

In addition, factors contributing to energy consumption in the waiting state include, for example, in order to compensate for the amount of heat dissipated from the steam generating part 10 and the superheated steam generating part 20 through, for example, a heat insulating material, applying energy corresponding to the amount of heat to the steam generating part 10 and the superheated steam generating part 20.

Further, since in the waiting state, the second heating temperature is controlled to the temperature of the superheated steam generated by the superheated steam generating part 20 or a temperature around that temperature, when the saturated steam is supplied to the superheated steam generating part 20, the heating of the saturated steam is immediately started. As a result, the time to generate the superheated steam can be further shortened.

Meanwhile, since the second heating temperature is sufficiently higher than the temperature of the saturated steam, when a large amount of the saturated steam suddenly flows into the superheated steam generating part 20, heat shock occurs in the superheated steam generating part 20. On the other hand, in the superheated steam generator 100 according to the present embodiment, since the on/off valve 40 is controlled so as to gradually increase the valve opening degree thereof from the zero state to the predetermined opening degree, the steam is gradually supplied to the superheated steam generating part 20 from the point in time when the waiting state is switched to the supply state. As a result, the above-described heat shock can be reduced despite generating the superheated steam in a short period of time.

Note that the second heating temperature control part 52 in the present embodiment controls the second heating temperature on the basis of the measured value of the second temperature sensor T2 for the predetermined time from the point in time when the waiting state is switched to the supply state to the point in time when the lead-out of the superheated steam is started. In addition, from the point in time when the predetermined time has passed, the second heating temperature control part 52 controls the second heating temperature on the basis of the measured value of the third temperature sensor T3.

As a result, although a time lag occurs between the point in time when the waiting state is switched to the supply state and the point in time when the generation of the superheated steam is started, the second heating temperature control part 52 in the present embodiment can accurately control the second heating temperature correspondingly to the time lag.

In addition, since the pressure regulating valve 30 regulates the pressure of the saturated steam to be supplied to the superheated steam generating part 20 to the predetermined pressure, the saturated steam can be stably supplied to the superheated steam generating part 20 in the supply state. As a result, the superheated steam led out of the fluid lead-out port of the superheated steam generating part 20 can also keep a stable flow rate, and therefore a user can stably use the superheated steam.

Further, since for the predetermined time after the point in time when the operation for switching from the supply state to the waiting state was performed, the saturated steam is supplied from the steam generating part 10 to the superheated steam generating part 20, the superheated steam generating part 20 kept at the high temperature in the supply state can be cooled down to then switch to the waiting state. As a result, the superheated steam generating part 20 can be cooled down to a setting temperature in the waiting state to prevent the superheated steam generator 100 from being damaged.

Note that the present invention is not limited to the above-described embodiment.

For example, in the above-described embodiment, the respective heating means are configured to heat the respective corresponding heating elements by the induction heating method; however, the respective heating means may be configured to heat the respective corresponding heating elements by an electric heating method.

Also, the steam generating part in the above-described embodiment heats the water to generate the saturated steam, but may generate superheated steam having a slightly higher temperature than the temperature of the saturated steam.

In this case, it is only necessary that the superheated steam generating part is configured to further heat the superheated steam having a slightly higher temperature than the temperature of the saturated steam generated by the steam generating part to generate the superheated steam of the predetermined temperature.

Further, the first and second heating temperature control parts in the above-described embodiment control the temperatures of the first and second heating elements as the first and second heating temperatures, but may be adapted to control, for example, setting temperatures externally inputted to the first and second heating means as the first and second heating temperature, respectively.

In addition, the pressure regulating valve control part in the above-described embodiment is configured to control the valve opening degree of the pressure regulating valve to the predetermined opening degree so as to make the saturated steam reach the predetermined pressure, but may be configured to control the valve opening degree of the pressure regulating valve to a predetermined opening degree so as to, for example, make the temperature of the saturated steam equal to a predetermined temperature.

Figure 4:
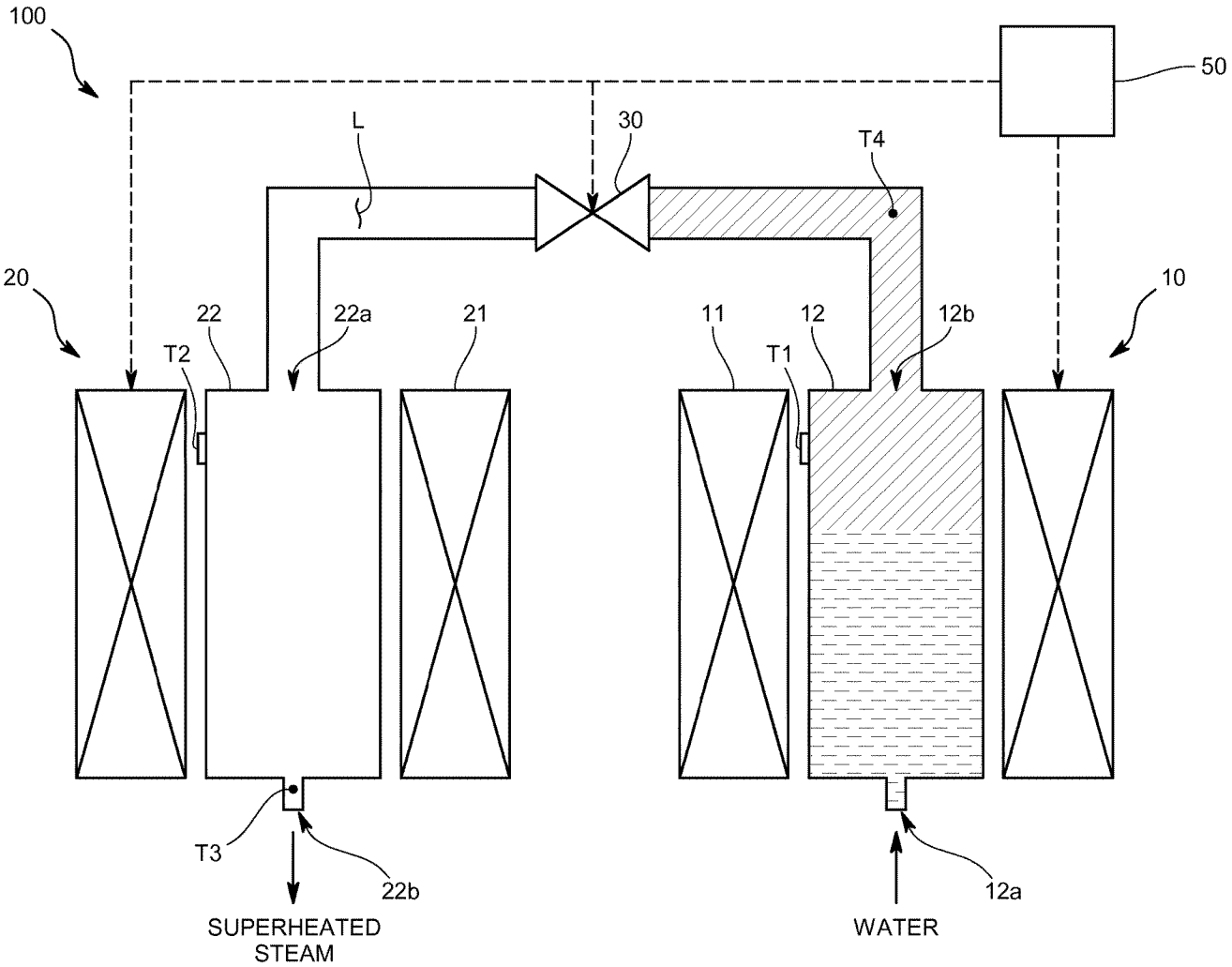
FIG. 4 is a diagram schematically illustrating a configuration of a superheated steam generator in another embodiment.

The pressure regulating valve control part in this case may be adapted to obtain the measured value of the first temperature sensor T1 as the temperature of the saturated steam, or as illustrated in FIG. 4, may be adapted to obtain the measured value of the fourth temperature sensor T4 provided in the supply flow path L as the temperature of the saturated steam.

Further, in the above-described embodiment, the control device 50 is configured to control each of the pressure regulating valve 30 and the on/off valve 40, but may be adapted to control the pressure regulating valve 30 with, for example, as illustrated in FIG. 4, the pressure regulating valve 30 made to fulfill a function as the on/off valve 40.

Specific citable control is the control in which the control device 50 controls the pressure regulating valve 30 to gradually increase the pressure of the saturated steam supplied from the steam generating part 10 to the superheated steam generating part 20, and thereby the waiting state is switched to the supply state.

In the above-described configuration, the pressure regulating valve 30 has both on/off and pressure regulating functions, and therefore the number of valves provided in the supply flow path L can be reduced to one to reduce cost.

Besides, it should be appreciated that the present invention is not limited to any of the above-described embodiments, but can be variously modified without departing from the scope thereof.

REFERENCE CHARACTER LIST

100: Superheated steam generator
10: Steam generating part
11: First heating means
12: First heating element
20: Superheated steam generating part
21: Second heating means
22: Second heating element
L: Supply flow path
30: Pressure regulating valve
40: On/off valve
50: Control device

The invention claimed is:

1. A superheated steam generator comprising:

a steam generating part that comprises a first heating conductive tube having a first fluid introduction port which is supplied with water and a first fluid lead-out port which leads out steam, and heats the first heating conductive tube by induction heating via induction coils wrapped around the first heating conductive tube, and generates steam from water;

a superheated steam generating part that comprises a second heating conductive tube having a second fluid introduction port which is supplied with the steam generated by the steam generating part and a second fluid lead-out port which leads out superheated steam, and heats the second heating conductive tube by induction heating via induction coils wrapped around the second heating conductive tube, and generates superheated steam from the steam;

a first temperature sensor provided in the first heating conductive tube for detecting a temperature of the steam generating part;

a second temperature sensor provided in the second heating conductive tube for detecting a temperature of the superheated steam generating part;

a third temperature sensor provided in the second fluid lead-out port or in a vicinity of the second fluid lead-out port for detecting a temperature of the superheated steam;

a switching mechanism that is provided between the steam generating part and the superheated steam generating part, and switches between supplying the steam or stopping a supply of the steam to the superheated steam generating part; and a control device that is configured to control the switching mechanism, wherein:

the control device is configured to send a control signal to the switching mechanism for switching between a waiting state in which the steam generating part generates the steam and the supply of the steam is stopped, or a supply state in which the steam is supplied to the superheated steam generating part, to thereby switch between supplying the steam or stopping the supply of the steam;

the control device comprises a temperature control part that is configured to control a heating temperature of the superheated steam generating part and a heating temperature of the steam generating part;

the temperature control part is configured to send a control signal to the superheated steam generating part for controlling the heating temperature of the superheated steam generating part to be a temperature higher than the heating temperature of the steam generating part in the waiting state;

the temperature control part is configured to send a control signal for controlling the heating temperature of the superheated steam generating part on a basis of a signal indicating a temperature of the superheated steam generating part output from the second temperature sensor in the waiting state, and in the supply state, send a control signal for controlling the heating temperature of the superheated steam generating part on a basis of a signal indicating a temperature of the superheated steam output from the third temperature sensor;

upon receiving a switching signal for switching from the supply state to the waiting state, the control device is configured to continue the supply of the steam from the steam generating part to the superheated steam generating part to cool down the superheated steam generating part until a predetermined time period has elapsed since receiving the switching signal; and after the predetermined time period has elapsed since receiving the switching signal, the control device is configured to send a control signal to the switching mechanism for stopping the supply of the steam to the superheated steam generating part.

2. The superheated steam generator according to claim 1, wherein:

the switching mechanism is an on/off valve, the control device comprises a valve control part adapted to control the on/off valve, and the valve control part is configured to send a control signal to the on/off valve for switching from the waiting state to the supply state, to thereby gradually open the on/off valve from a closed state to a predetermined valve opening degree.

3. The superheated steam generator according to claim 1, wherein:

the switching mechanism is a pressure regulating valve provided between the steam generating part and the superheated steam generating part, the control device comprises a valve control part adapted to control the pressure regulating valve, and the valve control part is configured to send a control signal to the pressure regulating valve for switching from the waiting state to the supply state to thereby control the pressure regulating valve and regulate pressure of the steam to be supplied to the superheated steam generating part.

4. The superheated steam generator according to claim 1, wherein:

the temperature control part is configured to receive a predetermined time passage signal after a predetermined time has passed since a point in time when the switching from the waiting state to the supply state was performed, wherein before receiving the predetermined time passage signal, the temperature control part is configured to send a control signal for controlling the heating temperature of the superheated steam generating part based on the temperature of the superheated steam generating part, and after receiving the predetermined time passage signal, the temperature control part is configured to send a control signal for controlling the heating temperature of the superheated steam generating part based on the temperature of the superheated steam.

* * * * *